US008870332B2

(12) United States Patent
Takeuchi et al.

(10) Patent No.: US 8,870,332 B2
(45) Date of Patent: Oct. 28, 2014

(54) TRANSPORT DEVICE AND INKJET PRINTING APPARATUS HAVING THE SAME

(71) Applicant: Dainippon Screen Mfg. Co., Ltd., Kyoto (JP)

(72) Inventors: Katsuaki Takeuchi, Kyoto (JP); Shoji Kakimoto, Kyoto (JP)

(73) Assignee: Dainippon Screen Mfg. Co., Ltd. (JP)

( * ) Notice: Subject to any disclaimer, the term of this patent is extended or adjusted under 35 U.S.C. 154(b) by 0 days.

(21) Appl. No.: 14/136,472

(22) Filed: Dec. 20, 2013

(65) Prior Publication Data

US 2014/0232779 A1 Aug. 21, 2014

(30) Foreign Application Priority Data

Feb. 18, 2013 (JP) ..... 2013-029184

(51) Int. Cl.
*B41J 29/38* (2006.01)
*B41J 2/01* (2006.01)
*B41J 13/00* (2006.01)

(52) U.S. Cl.
CPC ..... *B41J 13/0009* (2013.01)
USPC ..... 347/16; 347/101; 347/104

(58) Field of Classification Search
CPC ..... B41J 29/38; B41J 11/42; B41J 11/007; B41J 3/0009
USPC ..... 347/5, 16, 101, 104
See application file for complete search history.

(56) References Cited

U.S. PATENT DOCUMENTS

2006/0267528 A1 11/2006 Rehm ..... 318/432
2007/0051264 A1 3/2007 Sakamoto ..... 101/484
2011/0315036 A1 12/2011 Bouma et al. ..... 101/484
2012/0026266 A1* 2/2012 Akahane ..... 347/104
2012/0056927 A1* 3/2012 Mitsuhashi et al. ..... 347/16
2012/0087707 A1 4/2012 Igarashi ..... 400/611
2013/0057629 A1* 3/2013 Miyamoto et al. ..... 347/104

FOREIGN PATENT DOCUMENTS

JP S54-167983 11/1979
JP H04-333459 11/1992
JP 4722631 7/2011

OTHER PUBLICATIONS

Extended European Search Report dated Jun. 20, 2014 in the corresponding European Patent Application No. 13196011.4.

* cited by examiner

*Primary Examiner* — Jannelle M Lebron
(74) *Attorney, Agent, or Firm* — Ostrolenk Faber LLP

(57) ABSTRACT

A transport device includes a plurality of transporting sections to transport a printing medium; a divided accelerating interval setting section to set a transportation speed in a divided accelerating interval corresponding to a time generated by dividing a time where the transportation speed of the printing medium changes from 0 to a given value in accordance with an acceleration rate; a divided decelerating interval setting section to set a transportation speed in a divided decelerating interval corresponding to a time generated by dividing a time where the transportation speed of the printing medium changes from the given value to 0 in accordance with an decelerating rate; including a basic shaft transporting section configured to be driven at the transportation speed set for every divided accelerating interval or for every divided decelerating interval for transporting the printing medium; and a controller for controlling the foregoing sections.

16 Claims, 6 Drawing Sheets

TRANSPORT DEVICE AND INKJET PRINTING APPARATUS HAVING THE SAME

BACKGROUND OF THE INVENTION (1) Field of the Invention

The present invention relates to a transport device configured to transport a printing medium such as web paper in a given direction for printing and an inkjet printing apparatus having the transport device.

(2) Description of the Related Art

Examples of such the apparatus of this type conventionally include a printing apparatus having a plurality of measuring sections, a plurality of transporting sections, and a controller. The printing apparatus performs printing while transporting strip web paper on a transportation path. See, for example, Japanese Patent No. 4722631A.

The plurality of measuring sections measures tension of the web paper at a plurality of portions on the transportation path. The plurality of transporting sections transports the web paper adjacent to each of the plurality of measuring sections. The controller controls each of transportation speeds of the plurality of transporting sections in accordance with measurement results from the plurality of measuring sections. Here, the controller controls a transportation speed of one of the plurality of transporting sections on the most upstream side of the transportation path such that a measurement result from the measuring section adjacent to the transporting section is made close to a given value. In addition, the controller controls transportation speeds of the others of the plurality of transporting sections such that measurement results from the measuring sections on upstream and downstream sides of the transporting sections other than the basic shaft transporting section are close to the measurement result from the measuring section on the upstream side. This allows application of constant tension to the web paper at a plurality of portions on the transportation path.

However, the example of the conventional apparatus with such a construction has the following problem.

Specifically, the conventional apparatus adopts the transporting section on the most upstream side of the transportation path as a basic shaft. The conventional apparatus controls the transportation speed of the transporting section on the upstream side such that each of the transporting sections has measurement result on tension with a desired value. This enables balance of the transportation speed on the transportation section in an accelerating interval and a constant interval. The transportation speed of the web paper increases in the accelerating interval, whereas the transportation speed of the web paper is constant in the constant interval. However, in a decelerating interval where the transportation speed of the web paper decreases, the transportation speed on the transportation section may be non-uniform occasionally. This causes such a possible problem that irregular slack or damages may occur in the web paper.

SUMMARY OF THE INVENTION

The present invention has been made regarding the state of the art noted above, and its one object is to provide a transport device and an inkjet printing apparatus having the transport device, the transport device being configured to suppress irregular slack or damages in a printing medium upon increasing or decreasing a transportation speed of the printing medium by performing cooperative control to a plurality of transporting units.

In order to accomplish the above object, the present invention adopts the following construction.

One aspect of the present invention discloses a transport device configured to transport a printing medium along a transportation path. The apparatus includes a plurality of transporters configured to transport the printing medium on the transportation path; a divided accelerating interval setter configured to set a transportation speed in a divided accelerating interval, the divided accelerating interval corresponding to a time generated by dividing a time in an acceleration interval where the transportation speed of the printing medium changes from 0 to a given value in accordance with an acceleration rate; a divided decelerating interval setter configured to set a transportation speed in a divided decelerating interval, the divided decelerating interval corresponding to a time generated by dividing a time in a decelerating interval where the transportation speed of the printing medium changes from the given value to 0 in accordance with an decelerating rate; a basic shaft transporter, as one of the plurality of transporters, configured to be driven at the transportation speed set for every divided accelerating interval or for every divided decelerating interval and to function as a basic shaft upon transporting the printing medium; and a controller configured to switch the transportation speeds of the transporters of the plurality of transporters other than the basic shaft transporter in synchronization with a switching timing of the divided accelerating interval or the divided decelerating interval by the basic shaft transporter so as to increase or decrease the transportation speed of the printing medium.

With the construction of the present invention, the controller switches the transportation speeds of the transporters other than the basic shaft transporter in synchronization with the switching timing of the transportation speed in the divided accelerating interval or that in the divided decelerating interval by the basic shaft transporter so as to increase or decrease the transportation speed of the printing medium. Here, the transportation speed of the divided accelerating interval is set by the divided accelerating interval setter, and that of the divided decelerating interval is set by the divided decelerating interval setter. Consequently, the transporters other than the basic shaft transporter perform cooperative control with the basic shaft transporter, resulting in suppression of irregular slack or damages in the printing medium upon increasing or decreasing the transportation speed of the printing medium.

Moreover, it is preferable that the aspect of the present invention further includes tension measures adjacent to the transporters other than the basic shaft transporter and configured to measure tension of the printing medium, and that the transporters other than the basic shaft transporter make fine adjustment of the transportation speeds in accordance with measurement results from the tension measures.

With the construction of the present invention, the transporters other than the basic shaft transporter make fine adjustment of the transportation speeds in accordance with the measurement results from the tension measures. This enables the transporters other than the basic shaft transporter to transport the printing medium with high accuracy.

Moreover, it is preferable that the present invention relates to an inkjet printing apparatus including the above transport device and further including inkjet heads configured to eject ink droplets to the printing medium transported by the transport device.

With the construction of the present invention, the transport device transports the printing medium printed by the inkjet heads. This allows suppression of irregular slack or damages in the printing medium upon increasing or decreasing the transportation speed of the printing medium. Consequently, planarity of the printing medium adjacent to the inkjet heads can be enhanced, resulting in enhanced printing quality.

It is to be understood that both the foregoing general description and the following detailed description are exemplary and explanatory and are intended to provide further explanation of the invention as claimed.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Description will be given hereinafter in detail of a preferred embodiment of the present invention with reference to drawings.

Figure 1:
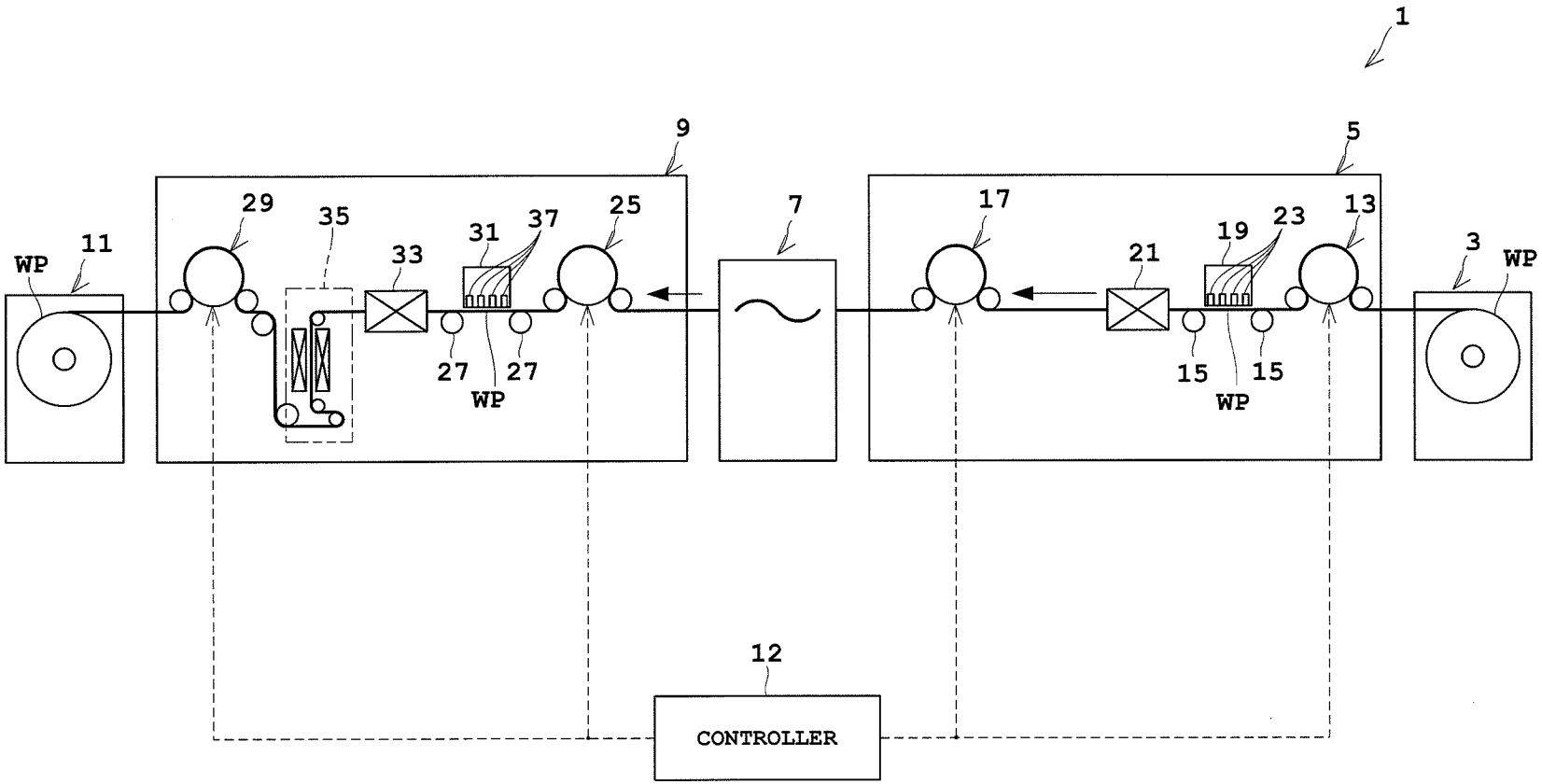
FIG. 1 is an entire view schematically illustrating an inkjet printing apparatus according to one embodiment.

FIG. 1 is an entire view schematically illustrating an inkjet printing apparatus including a transport device according to one embodiment of the present invention.

An inkjet printing apparatus 1 according to the embodiment includes a paper feeder 3, a surface printing unit 5, an inversion unit 7, a rear face printing unit 9, a take-up roller 11, and a controller 12.

The paper feeder 3 holds web paper WP in a roll form to be rotatable about a horizontal axis. The paper feeder 3 unreels the web paper WP to feed it to the surface printing unit 5. The take-up roller 11 unreels the web paper WP about a horizontal axis. Here, the web paper WP has both printed sides.

The web paper WP corresponds to the "printing medium" in the present invention.

The surface printing unit 5 includes a drive unit 13 in an upstream position thereof. The drive unit 13 takes the web paper WP from the paper feeder 3 on a transportation path. The web paper WP unreeled from the paper feeder 3 by the drive unit 13 is transported downstream on the transportation path along a plurality of transporting units 15. The surface printing unit 5 includes a drive unit 17 on the most downstream position thereof. A printer 19 and a drying unit 21 are arranged in this order from the upstream on the transportation path between the drive units 13 and 17. The printer 19 includes inkjet heads 23. Each of the inkjet heads 23 ejects ink droplets, thereby performing printing. The drying unit 21 dries the web paper WP printed by the printer 19.

The inversion unit 7 inverts a side of the web paper WP fed out from the drive unit 17 of the surface printing unit 5. Then the inversion unit 7 feeds out the inverted web paper WP to the rear face printing unit 9.

The rear face printing unit 9 includes a driving unit 25 in an upstream position thereof for taking in the web paper WP from the inversion unit 7 on the transportation path. The web paper WP taken by the drive unit 25 is transported downstream on the transportation path along a plurality of transporting units 27. The rear face printing unit 9 includes a drive unit 29 in the most downstream position thereof. The rear face printing unit 9 includes a printer 31, a drying unit 33, and a both-side inspecting apparatus 35 in this order from the upstream thereof on the transportation path between the drive units 25 and 29. The printer 31 includes inkjet heads 37. Each of the inkjet heads 37 ejects ink droplets, thereby performing printing. The drying unit 33 dries the web paper WP printed by the printer 31. The both-side inspecting apparatus 35 inspects both printed sides of the web paper WP printed by the printers 19 and 31.

The controller 12 receives printing data from a computer, not shown. Then the controller 12 controls the surface printing unit 5 and the rear face printing unit 9 in accordance with the printing data to print an image based on the printing data to both sides of the web paper WP.

Figure 2:
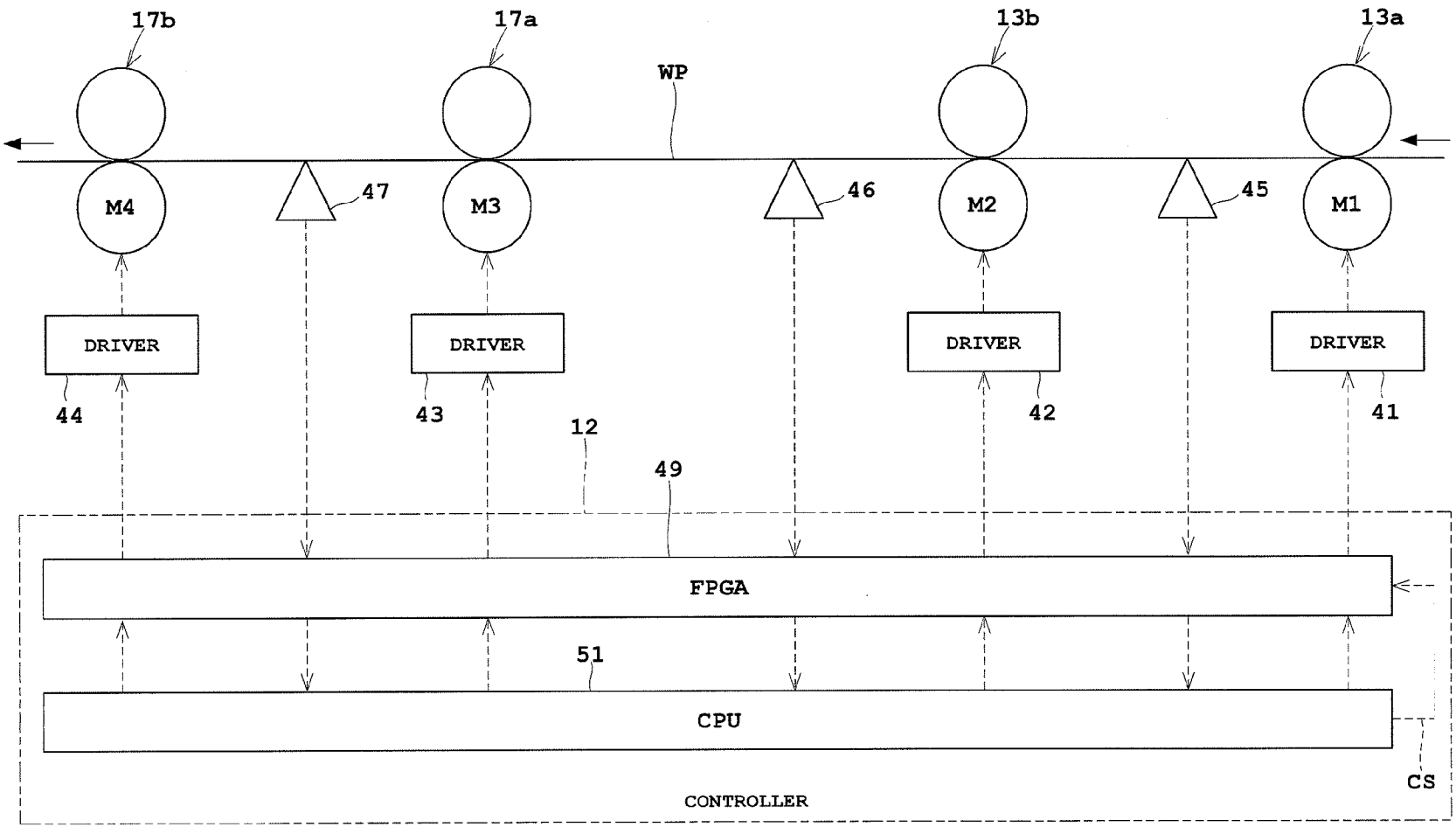
FIG. 2 is a block diagram illustrating a principal part of a transport control system of a surface printing unit.

Now reference is made to FIG. 2. FIG. 2 is a block diagram illustrating a principal part of a transport control system of the surface printing unit. The rear face printing unit 9 also has a construction substantially same as that of the surface printing unit.

The drive unit 13 includes drive rollers 13*a* and 13*b*. The drive unit 17 includes drive rollers 17*a* and 17*b*. The drive roller 13*a* is driven by a motor M1. The drive roller 13*b* is driven by a motor M2. The drive roller 17*a* is driven by a motor M3. The drive roller 17*b* is driven by a motor M4. The motors M1 to M4 are each a pulse motor having a controllable rotation speed. Moreover, the motor M1 is driven by a driver 41. The motor M2 is driven by a driver 42. The motor M3 is driven by a driver 43. The motor M4 is driven by a driver 44.

A tension sensor 45 is provided downstream of the drive roller 13*a* and upstream of the drive roller 13*b*. A tension sensor 46 is provided downstream of the drive roller 13*b* and upstream of the drive roller 17*a*. A tension sensor 47 is provided downstream of the drive roller 17*a* and upstream of the drive roller 17*b*. The tension sensors 45 to 47 each detect tension applied to the web paper WP and output a tension signal upon transporting the web paper WP.

The controller 12 includes an FPGA 49 and a CPU 51. The FPGA 49 (Field-Programmable Gate Array) is a programmable-logic gate array. The FPGA 49 outputs a drive pulse to each of the drivers 41 to 44. The FPGA 49 also receives the tension signal from each of the tension sensors 45 to 47. The CPU 51 controls the FPGA 49. Upon receiving an external start signal of starting printing, the CPU 51 operates the FPGA 49 to control each drive of the motors M1 to M4. The CPU 51 issues a command to the FPGA 49 to operate the motors M1 to M4. In addition, the CPU 51 receives the tension signals of the tension sensors 45 to 47 from the FPGA 49 to perform control, to be mentioned later, along with the FPGA 49.

The CPU 51 calculates a base driving waveform to be mentioned later in accordance with a parameter on acceleration and deceleration inputted and set by an operator. Then the CPU 51 sends the calculated base driving waveform to the FPGA 49. Examples of the parameter on acceleration and deceleration include a time in the accelerating interval where the transportation speed changes from 0 to a given transportation speed, an accelerating rate, the given transportation speed, a time when the transportation speed is constant after the accelerating interval, a time in the decelerating interval where the transportation speed changes from the given transportation speed to 0, and an decelerating rate. Here, the accelerating rate is an acceleration speed at which the transportation speed changes from a stop state to a target speed. The decelerating rate is an acceleration speed at which the transportation speed changes from the target speed to the stop state. The accelerating rate and the decelerating rate are both settable by a user. The accelerating rate may be different from the decelerating rate. These rates enable setting of an appropriate accelerating and deceleration speeds to the web paper WP.

Moreover, the CPU 51 determines the transportation speed in the divided accelerating interval corresponding to each time generated by dividing the accelerating interval in accordance with the acceleration rate, and determines the transportation speed in the divided decelerating interval corresponding to each time generated by dividing the decelerating interval in accordance with the decelerating rate, thereby setting the base driving waveform. The FPGA 49 operates the motors M1 to M4 via the drivers 41 to 44, respectively, in accordance with the base driving waveform, thereby transporting the web paper WP. In the embodiment, the drive roller 13*b* is used as a basic shaft. The FPGA 49 operates rotation of the motors M1, M3, and M4 via the drivers 41, 43, and 44, respectively, in accordance with the tension signals from the tension sensors 45 to 47. Accordingly, the FPGA 49 performs driving in accordance with the base driving waveform. Simultaneously, the FPGA 49 makes fine adjustment to the transportation speeds of the drive units 13, 25, and 29. Such the fine adjustment allows accurate transportation by the drive rollers 13*a*, 17*a*, and 17*b*.

The drive rollers 13*a*, 13*b*, 17*a*, and 17*b* correspond to the "transporter" in the present invention. The drive roller 13*b* corresponds to the "basic shaft transporter" in the present invention. The controller 12 corresponds to the "controller" in the present invention. The CPU 51 corresponds to the "divided accelerating interval setter" and the "divided decelerating interval setter" in the present invention. The tension sensors 45 to 47 correspond to the "tension measures" in the present invention.

Figure 3:
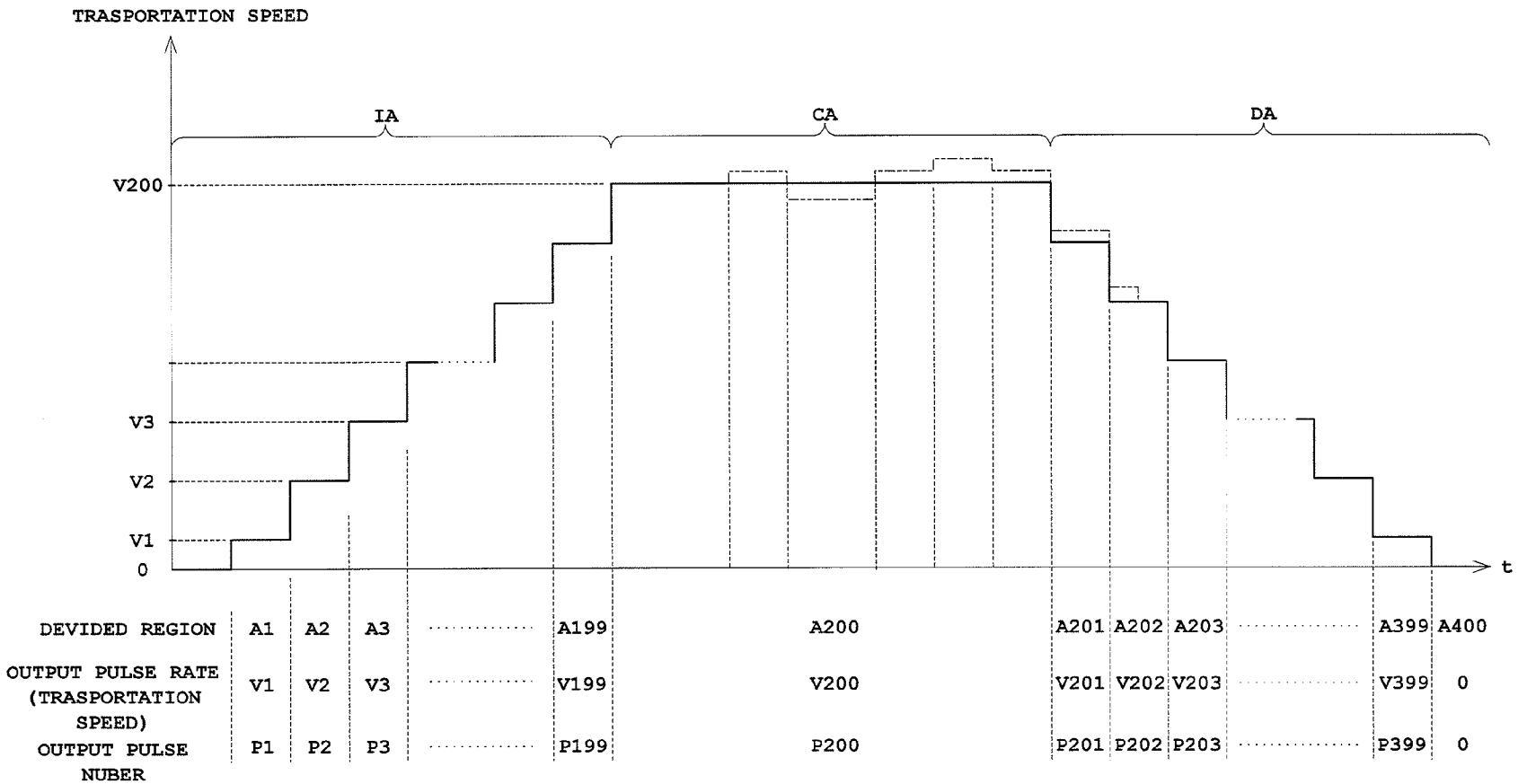
FIG. 3 is a timing chart of one example of controlling transportation.
Figure 4:
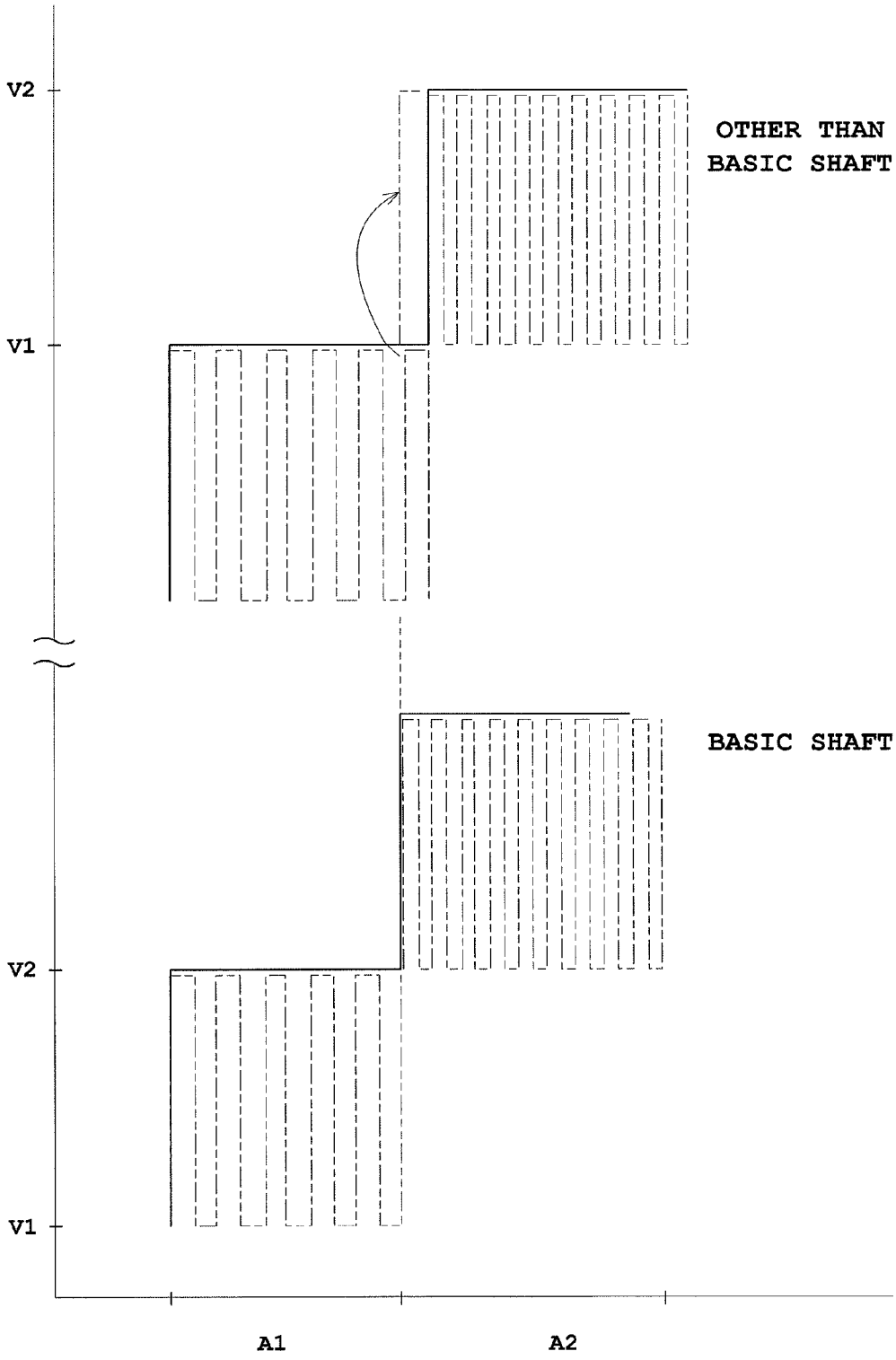
FIG. 4 is an explanatory schematic view illustrating a timing of switching a driving waveform.

Now reference is made to FIGS. 3 and 4. FIG. 3 is a timing chart illustrating one example of controlling transportation. FIG. 4 is an explanatory schematic view of a timing of switching the driving waveform.

In this example, the number of divided accelerating intervals is 199, and the number of divided decelerating intervals is 199. Moreover, in this example, an interval where the transportation speed changes from 0 to a transportation speed of V200 is expressed by an accelerating interval IA, an interval where the transportation speed is constant is expressed by a constant speed interval CA, and an interval where the transportation speed changes from the transportation speed of V200 to 0 is expressed by an decelerating interval DA. Here, the accelerating interval IA is divided into divided times as divided regions A1, A2, . . . , and A199. The constant speed interval CA is one divided region A200. The decelerating interval DA is divided into divided times as divided regions A201, A202, . . . , and A399. The CPU 51 sets the transportation speeds V1 to V399 for the divided regions A1 to A399, respectively. Here, the transportation speeds V1 to V399 are each an output pulse rate. A higher pulse rate causes a higher transportation speed. Pulse numbers P1 to P399 are set for the divided regions A1 to A399, respectively, whereby the pulse number outputted in each of the divided A1 to A399 is defined.

Here, chain double-dashed vertical lines in the constant speed interval CA and the decelerating interval DA in FIG. 3 denote fine adjustment of the transportation speeds of the mentioned above drive rollers 13*a*, 17*a*, and 17*b*. These lines are control of the drive rollers 13*a*, 17*a*, and 17*b* other than the drive roller 13*b* as the basic shaft.

The controller 12 performs the following control when a base driving waveform given to the driver 42 of the drive roller 13*b* as the basic shaft shifts to a next divided region in the accelerating interval IA and the decelerating interval DA and when the drivers 41, 43, and 44 of the drive rollers 13*a*, 17*a*, and 17*b*, respectively, other than the basic shaft do not shift to the divided region. That is, the controller 12 controls the CPU 51 so as to output a divided region switching signal CS to the FPGA 49 when the base driving waveform given to the driver 42 of the drive roller 13*b* as the basic shaft shifts to the next divided region. Upon receiving the signal, the FPGA 49 issues a command to the drivers 41, 43, and 44 of the drive roller 13*a*, 17*a*, 17*b*, respectively, other than the basic shaft, to shift to the next divided region. In other words, the control is performed such that the drivers 41, 43, and 44 of the drive roller 13*a*, 17*a*, and 17*b*, respectively, other than the basic shaft, cooperate with the base driving waveform given to the driver 42 of the drive roller 17 as the basic shaft.

Reference is now made to FIG. 4. This example illustrates the divided regions A1 and A2 of the base driving waveform given to the driver 42 of the drive roller 13*b* as the basic shaft. FIG. 4 illustrates on the upper side a base driving waveform given to the drivers other than the drive roller 13*b* as the basic shaft (the drivers 41, 43, 44 of the drive rollers 13*a*, 17*a*, and 17*b*). Here, it is assumed that a timing of switching from the divided region A1 to the divided region A2 is shifted. In this case, the divided region switching signal CS is outputted to the FPGA 49 when the base driving waveform given to the driver 42 of the drive roller 13*b* as the basic shaft switches from the divided region A1 to the divided region A2. Accordingly, as illustrated by an arrow in FIG. 4, the divided region of the base driving waveform given to the drivers 41, 34, 44 of the drive rollers 13*a*, 17*a*, and 17*b*, other than the basic shaft, is switched in cooperation with the basic shaft. This is one example for the accelerating interval IA. Similar to this, the same cooperative control is performed to the decelerating interval DA.

Figure 5:
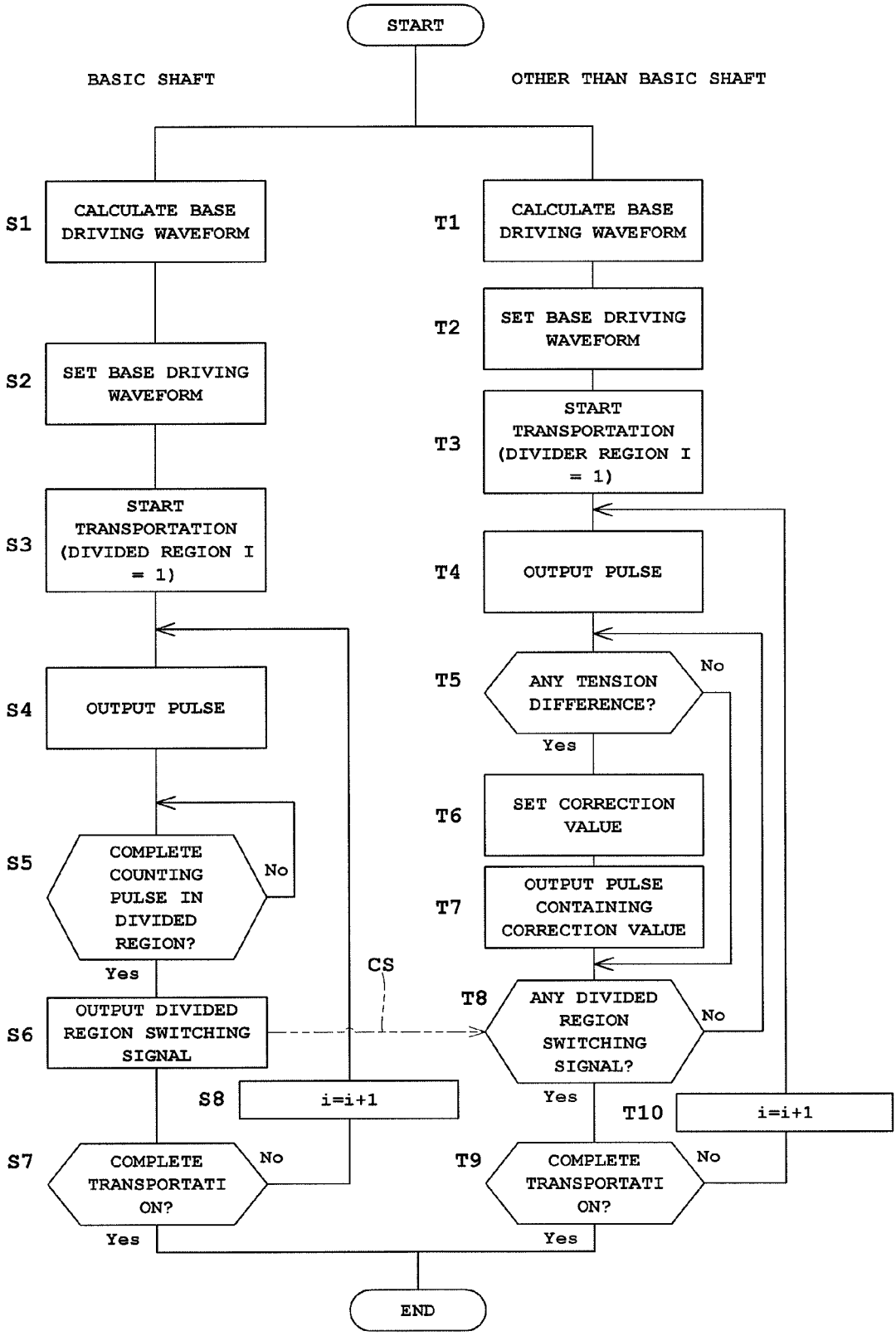
FIG. 5 is a flow chart illustrating operations.

Next, description will be next given of operation of the transport device of the inkjet printing apparatus 1 mentioned above with reference to FIG. 5. FIG. 5 is a flow chart illustrating the operation.

Firstly, description will be given of the basic shaft (drive roller 13*b*).

Step S1, S2

The CPU 51 of the controller 12 calculates a base driving waveform in FIG. 3 in accordance with operator's input. Then, the CPU 51 sets the base driving waveform to the FPGA 49 of the controller 12.

Step S3, S4

Transportation is started. Specifically, the controller 12 performs control to output a signal to the driver 42 in accordance with the base driving waveform to rotate the drive roller 13*b*.

Step S5, S6

The controller 12 performs control to cause the process to branch in accordance with whether or not counting of pulses in the divided region is completed. When the counting is not completed, step S5 is repeated. When the counting is completed, the process proceeds to step S6 to output a divided region switching signal CS.

Step S7, S8

The process branches in accordance with whether or not the transportation is completed. When the transportation is completed, the process is finished. When the transportation is not completed, the process (step S4) branches to pulse output to a next divided region in step S8.

Description will be next given of the drivers of the drive rollers other than the basic shaft (the drivers 41, 43, and 44 of the drive roller 13*a*, 17*a*, and 17*b*, respectively).

Since steps T1 to T4, T9, and T10 are the same process as the above steps to the basic shaft, description of the steps T1 to T4, T9, and T10 is to be omitted.

Step T5 to T7

Process branches in accordance with whether or not difference in tension exists. Specifically, the process is determined in accordance with whether or not difference exists between each of the tension signals from the tension sensors 45, 46, and 47 of the drive roller 13*a*, 17*a*, and 17*b* and a target value. When no difference exists, the process proceeds to step T8. When some difference exists, the controller 12 set a correction value to add the value to the pulse. Then the controller 12 outputs the pulse including the correction value to the corresponding drivers 41, 43, and 44 (step T7). This causes fine adjustment to the transportation speed, causing correction of the difference in tension.

Step T8

When the FPGA 49 of the controller 12 receives the divided region switching signal CS from the CPU 51, the FPGA 49 outputs a pulse to each of the drivers 41, 43, and 44 to shift to a next divided region even if the drive rollers 13*a*, 17*a*, and 17*b* other than the basic shaft are driven in the previous divided region. This achieves cooperative control with the drive roller 13*b* as the basic shaft.

According to this embodiment, the controller 12 switches the transportation speeds of the other drive rollers 13*a*, 17*a*, and 17*b* in synchronization with the switching timing of the transportation speed in the divided accelerating interval or that in the divided decelerating interval by the drive roller 13*b* as the basic shaft so as to increase or decrease the transportation speed of the web paper WP. He re, the CPU 51 sets the transportation speed in the divided accelerating interval and that in the divided decelerating interval. Consequently, the other drive rollers 13*a*, 17*a*, and 17*b* perform cooperative control with the drive roller 13*b*, resulting in suppression of irregular slack or damages in the web paper WP upon increasing or decreasing the transportation speed.

Moreover, the transport device of the inkjet printing apparatus 1 according to the embodiment transports the web paper WP printed by the inkjet heads 23 and 37. This allows suppression of irregular slack or damages in the web paper WP upon increasing or decreasing the transportation speed. Consequently, planarity of the web paper WP adjacent to the inkjet heads 23 and 37 can be enhanced, resulting in enhanced printing quality.

Figure 6:
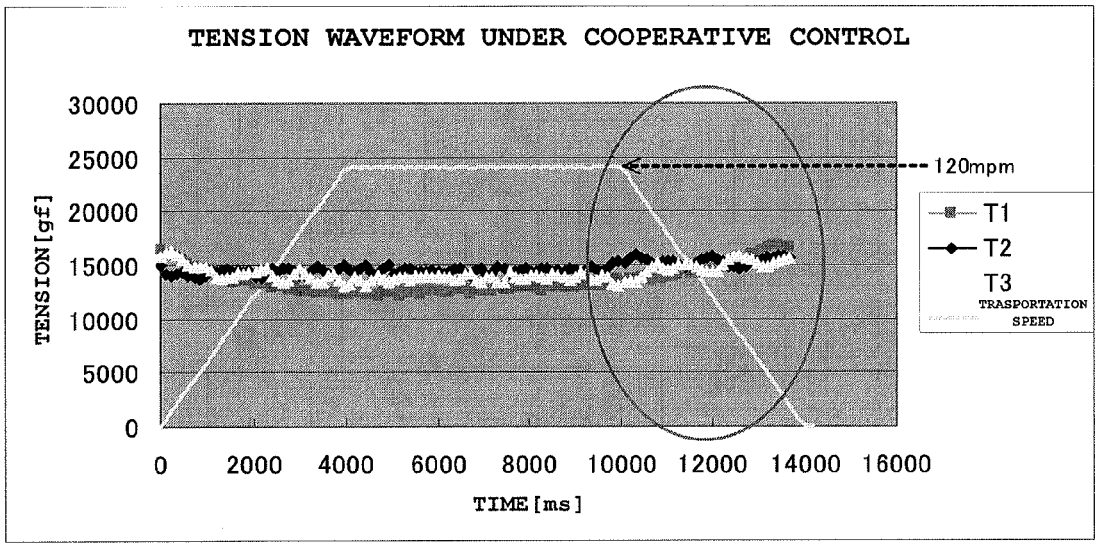
FIG. 6 is a graph of variations in a tension waveform according to the embodiment.
Figure 7:
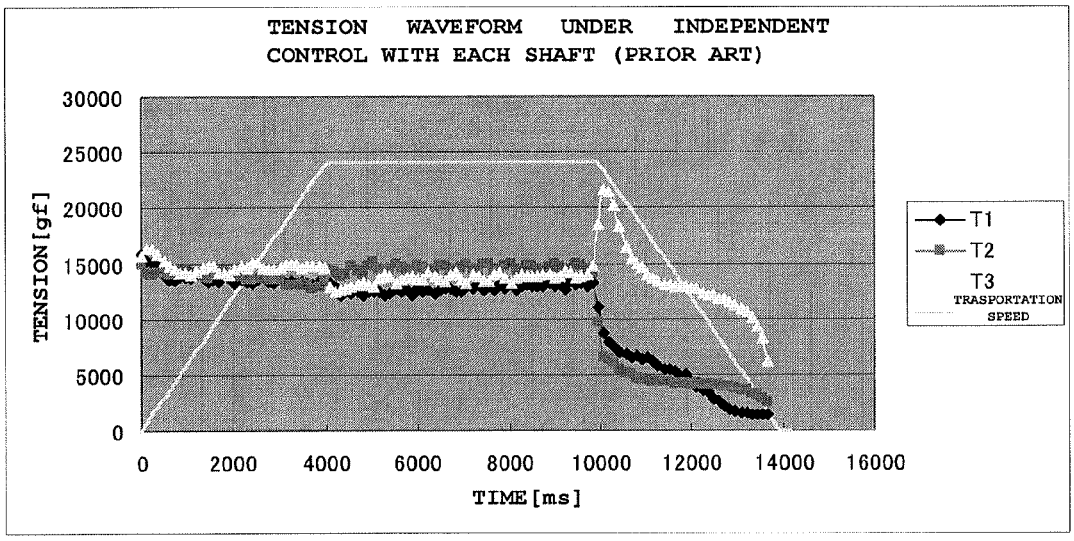
FIG. 7 is a graph of variations in a tension waveform according to a conventional apparatus.

Now reference is made to FIGS. 6 and 7. FIG. 6 is a graph illustrating variations in a tension waveform according to the embodiment of the present invention. FIG. 7 is a graph illustrating variations in a tension waveform according to a conventional apparatus.

With the cooperative control mentioned above, it is apparent that a tension variation upon deceleration is extremely small as illustrated by an ellipse in FIG. 6. On the other hand, with the conventional apparatus, it is apparent that each tension greatly varies upon the deceleration corresponding to a position of the ellipse in FIG. 6. These graphs indicate a significant effect in the cooperative control of the transport device according to the embodiment mentioned above.

This invention is not limited to the foregoing examples, but may be modified as follows.

(1) In the embodiment mentioned above, the web paper WP is used as the printing medium. Alternatively, a printing medium other than paper is applicable to the present invention. For instance, a film may be used as the printing medium.

(2) In the embodiment mentioned above, the drive roller 13*b* is used as the basic shaft. Alternatively, any of the drive rollers 13*a*, 17*a*, and 17*b* other than the drive roller 13*b* may be used as the basic shaft.

(3) In the embodiment mentioned above, the transport device of the inkjet printing apparatus 1 has been described as one example. Alternatively, the present invention is applicable when a transport device of an apparatus other than the inkjet printing apparatus 1 transports the printing medium.

This invention may be embodied in other specific forms without departing from the spirit or essential attributes thereof and, accordingly, reference should be made to the appended claims, rather than to the foregoing specification, as indicating the scope of the invention.

What is claimed is:

1. A transport device for transporting a printing medium along a transportation path, comprising:

a plurality of transporters configured to transport the printing medium on the transportation path;

a divided accelerating interval setter configured to set a transportation speed in a divided accelerating interval, the divided accelerating interval corresponding to a time generated by dividing a time in an acceleration interval where the transportation speed of the printing medium changes from 0 to a given value in accordance with an acceleration rate;

a divided decelerating interval setter configured to set a transportation speed in a divided decelerating interval, the divided decelerating interval corresponding to a time generated by dividing a time in a decelerating interval where the transportation speed of the printing medium changes from the given value to 0 in accordance with an decelerating rate;

a basic shaft transporter, as one of the plurality of transporters, configured to be driven at the transportation speed set for every divided accelerating interval or for every divided decelerating interval and to function as a basic shaft upon transporting the printing medium; and a controller configured to switch the transportation speeds of the transporters of the plurality of transporters other than the basic shaft transporter in synchronization with a switching timing of the divided accelerating interval or the divided decelerating interval by the basic shaft transporter so as to increase or decrease the transportation speed of the printing medium.

2. The transport device according to claim 1, further comprising:

tension measures adjacent to the transporters other than the basic shaft transporter and configured to measure tension of the printing medium, wherein the transporters other than the basic shaft transporter make fine adjustment of the transportation speeds in accordance with measurement results from the tension measures.

3. The transport device according to claim 1, wherein the acceleration rate differs from the deceleration rate.

4. The transport device according to claim 2, wherein the acceleration rate differs from the deceleration rate.

5. The transport device according to claim 1, wherein a constant speed interval between the acceleration interval and the deceleration interval has one divided time.

6. The transport device according to claim 2, wherein a constant speed interval between the acceleration interval and the deceleration interval has one divided time.

7. The transport device according to claim 3, wherein a constant speed interval between the acceleration interval and the deceleration interval has one divided time.

8. The transport device according to claim 4, wherein a constant speed interval between the acceleration interval and the deceleration interval has one divided time.

9. An inkjet printing apparatus, comprising:

the transport device according to claim 1; and inkjet heads configured to eject ink droplets to the printing medium transported by the transport device.

10. An inkjet printing apparatus, comprising:

the transport device according to claim 2; and inkjet heads configured to eject ink droplets to the printing medium transported by the transport device.

11. An inkjet printing apparatus, comprising:

the transport device according to claim 3; and inkjet heads configured to eject ink droplets to the printing medium transported by the transport device.

12. An inkjet printing apparatus, comprising:

the transport device according to claim 4; and inkjet heads configured to eject ink droplets to the printing medium transported by the transport device.

13. An inkjet printing apparatus, comprising:

the transport device according to claim 5; and inkjet heads configured to eject ink droplets to the printing medium transported by the transport device.

14. An inkjet printing apparatus, comprising:

the transport device according to claim 6; and inkjet heads configured to eject ink droplets to the printing medium transported by the transport device.

15. An inkjet printing apparatus, comprising:

the transport device according to claim 7; and inkjet heads configured to eject ink droplets to the printing medium transported by the transport device.

16. An inkjet printing apparatus, comprising:

the transport device according to claim 8; and inkjet heads configured to eject ink droplets to the printing medium transported by the transport device.

* * * * *